United States Patent [19]

Morris

[11] 4,018,674

[45] Apr. 19, 1977

[54] APPARATUS FOR AUTOMATICALLY GRADING LEAF TOBACCO

[76] Inventor: Bennie A. Morris, 206 W. Lavender Ave., Durham, N.C. 27704

[22] Filed: Nov. 26, 1974

[21] Appl. No.: 527,362

Related U.S. Application Data

[63] Continuation-in-part of Ser. No. 228,965, Feb. 24, 1972, abandoned.

[52] U.S. Cl. ..... 209/73; 209/74 R; 209/111.6; 209/111.7 R; 198/382; 198/442; 198/445; 131/146

[51] Int. Cl.[2] ..... B07C 5/342

[58] Field of Search ..... 209/73, 74 R, 111.6, 209/111.7; 198/29, 30, 31 R, 68, 78, 79, 102; 131/138, 149, 21 R, 131, 110, 146; 198/382, 442, 445, 446

[56] References Cited

UNITED STATES PATENTS

| | | | |
|---|---|---|---|
| 2,192,518 | 3/1940 | Eissmann | 198/30 |
| 2,873,747 | 2/1959 | Schlossmacher | 131/149 |
| 3,097,744 | 7/1963 | Hutter et al. | 209/111.6 |
| 3,439,793 | 4/1969 | Rakestraw | 198/382 X |
| 3,623,595 | 12/1969 | Brown et al. | 198/382 X |
| 3,750,881 | 8/1973 | Husome et al. | 209/74 R |
| 3,750,882 | 8/1973 | Hays | 209/111.6 |
| 3,773,172 | 11/1973 | McClure et al. | 209/73 |

FOREIGN PATENTS OR APPLICATIONS

| | | | |
|---|---|---|---|
| 1,013,533 | 12/1965 | United Kingdom | 131/149 |

*Primary Examiner*—Drayton E. Hoffman
*Assistant Examiner*—Joseph J. Rolla

[57] ABSTRACT

A system wherein tobacco leaves are dropped onto a continuously moving belt in a grid like pattern defined by means which are arranged to deliver the tobacco leaf in a sequential manner on the moving belt. The leaves, when arranged on the belt, are passed before a photo-electric detector which senses the color or reflectivity of same. An air blast ejector is positioned downstream of the detector for separating leaves determined to be undesirable.

25 Claims, 7 Drawing Figures

AIR SUPPLY
CONTROL
SOL.
82 (84)
56 (58, 60)

FIG. 3
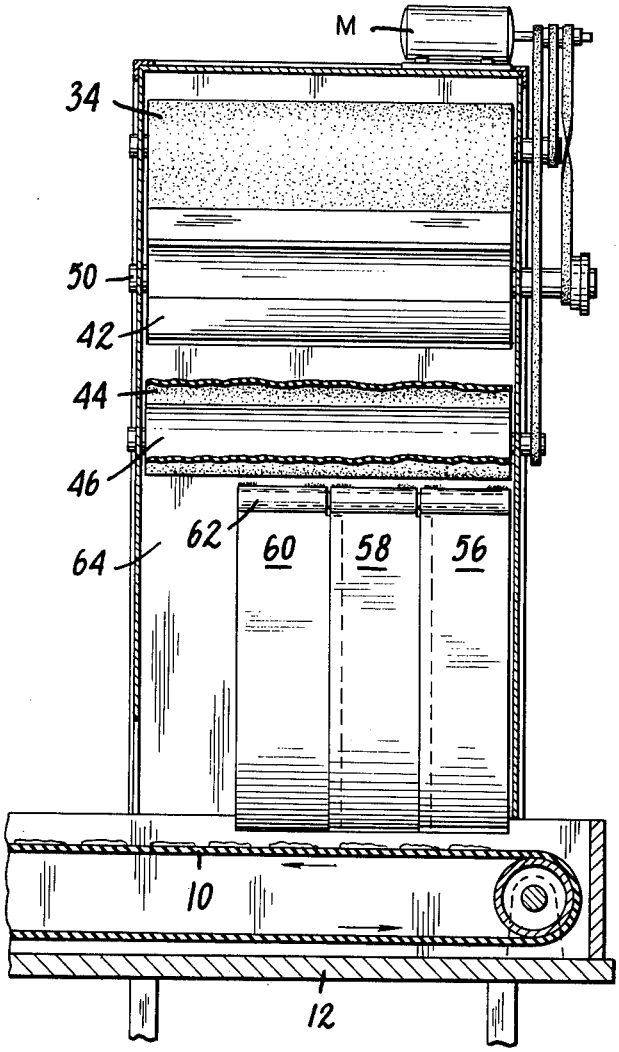
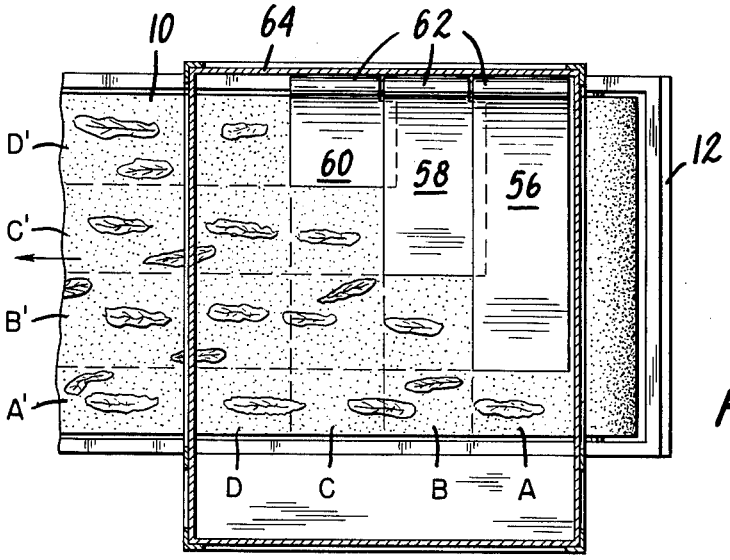
FIG. 4

APPARATUS FOR AUTOMATICALLY GRADING LEAF TOBACCO

RELATED APPLICATION

The present application is a continuation-in-part of Ser. No. 228,965, filed Feb. 24, 1972, now abandoned.

BACKGROUND OF INVENTION

The present invention relates to apparatus for processing tobacco leaf and in particular to a system and apparatus for grading and sorting such leaf which provides improved means for feeding the tobacco thereto and for receiving the same for grading.

Until recently the only way of grading and sorting tobacco leaves (i.e. separating the desirably colored and formed leaf from a mass of leaves supplied by the farmer) had been by hand. That is, manual laborers were required to pick through the collected leaves and extract from amongst the predominantly good leaves, those which are of the wrong color, texture and/or degree of uniformity required for the product. The picker was also required to extract the suckers, stems, rope, and any foreign matter collected within the leaf. Recently, automatic methods have been suggested to replace this total hand operation. In U.S. Pat. No. 3,368,568, one such method was suggested wherein the leaves were tumbled on a rotating turntable so that the leaves became separated and under centrifugal action were forced to arrange themselves individually for passage before a photo electric detector which would sense individual leaf of improper color, shape and uniformity etc. An air injection system was provided to remove the thus sensed improper leaf. Subsequently, in U.S. Pat. No. 3,380,460, Apr. 30, 1968, of F. Fuis, Jr., a linear table was employed dropping leaves through a number of gates. The first system has a disadvantage in that a large turntable was required to provide sufficient room for adequate separation while the second system had the disadvantage of having a complicated complex table and gate arrangement. Separation itself was not uniform and the speed of operation in both systems, was insufficient so that the total throughput did not match either in time or total cost that produced by manual labor.

More recently, apparatus has been disclosed in U.S. Pat. No. 3,750,882, issued to Gordon W. Hays, wherein the rotary turntable was replaced by the conventional linear "picking" table on which an endless belt conveyor was arranged. Such tables are common in every leaf processing plant. Here, however, the electronic and photo-detection system required that the tobacco be fed to the moving belt at such a rate that the tobacco became arranged on the belt in a plurality of parallel longitudinal rows or streams in each of which piece of tobacco had to be separated by a given distance from its preceding and succeeding piece. Single file rows of tobacco leaf spaced apart approximately 12 to 24 inches was required to enable efficient detection. To accomplish this, a complex mechanism for proportioning, dividing, separating and arranging the leaf in predefined channels was provided wherein the single file arrangement could be obtained.

To the contrary, it has now been found that the arrangement of leaf, either on end, up against a centrifugal wall or in predefined rows is not necessary. We have found that tobacco leaves need not be arranged in absolute single file, and that higher speeds for photo-detector scanning, movement of the belt and overall operation could be obtained without the complex mechanism suggested by the aforementioned prior devices.

Other disadvantages of the prior devices lie in the means for receiving the tobacco once it is selected and pneumatically ejected. In particular, the hoppers for receiving the leaves are subject to drafts and wind interference which affects the trajectory of individual leaf. Also the separation between adjacent hoppers has contributed to various operational malfunctions and hang-up of leaves on the edges of the hoppers.

It is an object of this invention to overcome the defects of the prior art.

It is another object of the present invention to provide means for feeding tobacco to a moving conveyor freely separated from each other.

It is another object of the present invention to provide means for feeding tobacco leaves to a scanning photo-detector wherein substantially each leaf is capable of being individually scanned.

It is an object of the present invention to provide a system of the type described including means for increasing the speed of the conveying table and the transport of tobacco leaves to the sensing head at faster intervals.

It is a further object of the present invention to provide an improved tobacco leaf grader and sorter operating at advanced high speeds, yet simpler in structure and operation.

Additional objects and numerous advantages will be seen from the following disclosure.

SUMMARY OF INVENTION

According to the present invention an improved grading and sorting of tobacco leaves is obtained by providing a system for delivering a plurality of leaves to a moving conveyor from a source comprising a relatively deep random stream by interposing between the conveyor and the source deflecting means having a plurality of inclined slide surfaces. The slide surfaces cause portions of the stream tobacco leaves to move relative to each other sequentially downward at angles to the direction of the stream and the conveyor. The leaves thus drop onto the conveyor spread out over the area of the conveyor.

According to the invention the tobacco leaves are fed to a plurality of inclined slides or chutes arranged above the moving conveyor which may be in the form of the conventional picking table belt. The chutes are arranged in staggered overlapping arrangement and at different angles to cause the leaf to be directed to specific areas, at any given moment, on the moving belt.

It is preferred that the chutes are arranged below a diversion or doffer wheel which changes the direction of movement of the leaf, angularly, before falling on the chutes and that the conveyor moves away from the chutes at a sharp angle perpendicular or normal to the inclined direction of slide. The change in direction acts to control the sequential spacing between successive leaves by alternating successive leaves in a tortuous flow path.

Preferably, the chutes are straight smooth pieces of sheet metal, either individually formed or integrally formed in a single unit. The slides portions are attached at their upper end to a common side wall of a housing and depend at varying angles, cantilevered above the belt. The chutes may be adjustably secured to the upper or back walls, so that the angle may be varied.

According to the further aspects of the present invention a cover is placed over the front end of the table and the hoppers to shroud the area and prevent interference with the trajectory of the leaf.

Still another aspect according to the invention is the provision of means for separating adjacent hoppers comprising a curved plate pivoted on the upper edge of a wall and having a center of gravity below the edge so that it does not become unbalanced on impact of leaf.

Yet another aspect of the present invention comprises a flat plate arranged over substantially the entire width and length of the table in order to create a longitudinal channel through which the conveyor would carry the leaves. Preferably, the plate lies about 4 – 8 inches from the surface of the belt and shields the conveyor except at its front and rear ends. This in effect produces, because of the action of the moving conveyor a wind tunnel by which air flows from the rear to the front end. As a result the leaves deposited on the conveyor belt are carried along at substantially the speed and velocity of the upper face of the conveyor belt. The individual leaf will not slip, fly, jump, etc., even at very high belt speeds. If desired auxiliary air flow means such as a positive fan or suction fan may be arranged at either end of the table.

Full details of the present invention are set forth in the following description and are seen in the accompanying drawings.

BRIEF DESCRIPTION OF DRAWINGS

In the accompanying drawings,

FIG. 3 is a side view of the device taken from line 3—3 of FIG. 2, FIG. 4 is a top plan view taken in the direction of line 4—4 of FIG. 1.

DESCRIPTION OF INVENTION

Figures 1, 6, 7:
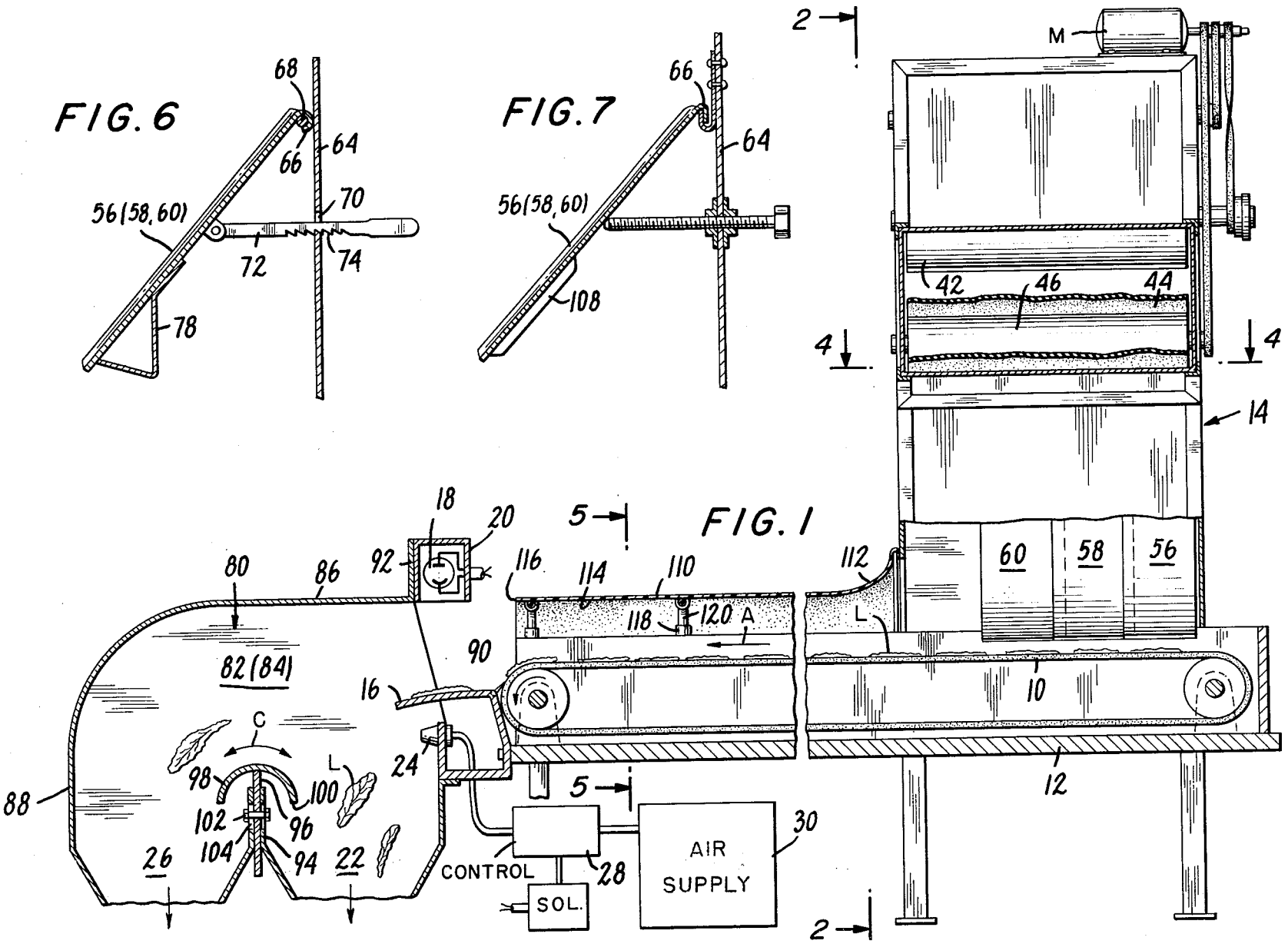
FIG. 1 is a side view of the leaf sorter and separator embodying the present invention.
FIG. 6 is a modification of the mounting means.
FIG. 7 is another modification of the mounting means.

Turning now to FIG. 1, a general outline of the tobacco leaf sorting and grading machine is seen wherein the conveyor is illustrated a conventional picking table comprising endless belt 10 is mounted on a pair of drive rollers journalled on a stationary support 12. Tobacco is dropped from a feeder 14 onto the belt 10 which is driven by a suitable motor attached to one of the drive rollers to subsequently move the tobacco in the linear direction of arrow A. At the front end of the conveyor 10 the tobacco passes over an end plate 16 and is scanned by one or more detectors 18 suitably located in a housing 20 mounted above the table. The detectors produce a signal indicative of the color, texture, reflectivity etc., of the desired tobacco leaf L. The desired tobacco leaf drops into the near hopper 22 while the undesirable tobacco leaf is blown by an air jet 24 mounted below the plate 16, into the far hopper 26.

When used in this specification, tobacco or tobacco leaf is intended to mean whole lear, or leaf cut into butts, tips or particles, the latter being threshed or not. Various size portions of leaf may be graded individually or in desired combinations.

The electronic detection system etc., may be of conventional design such as that fully described in any one of the aforementioned patents, or it may be, if desired, any other type suitable to detect the desired characteristic and to provide an electric impulse or signal by which a control system 28 may cause air under pressure, to be delivered from a source 30 to the nozzle 24 in timed sequence to blow the leaf.

As indicated previously, the prior art required that the leaf fed by the feeder 14 is deposited on the table in defined channels coinciding with the number of photosensors, in each of which leaves were separated from each other in order to insure accurate detection and subsequent rejection by the air system. Thus, of course, the rather complex and costly mechanism for feeding the leaves in the feeder 14 was required. In the aforementioned Hayes patent a plurality of paddle wheels, longitudinal counter rotating rollers, vertical baffles and channel gate means was employed.

Figures 2, 5:
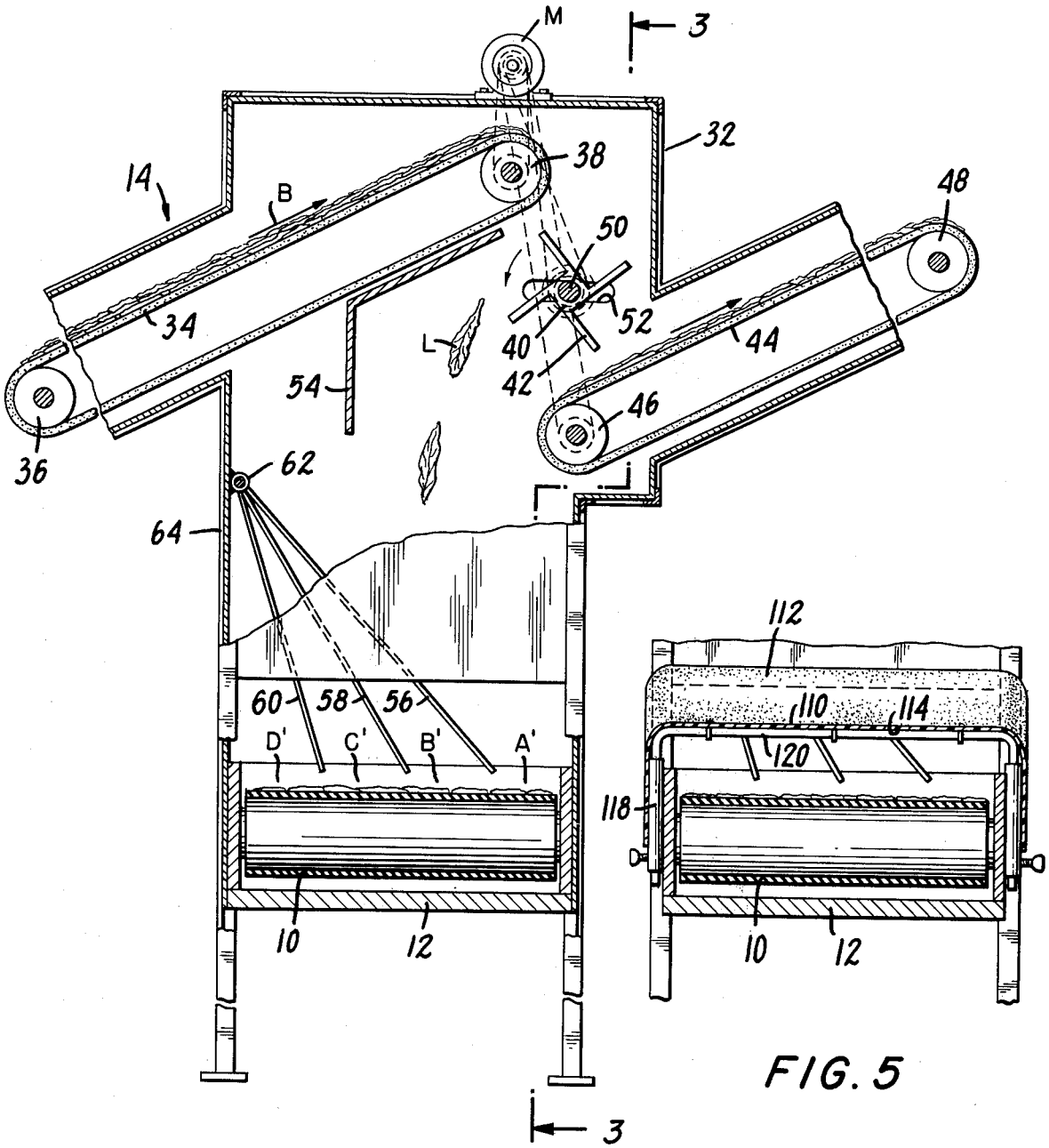
FIG. 2 is a front view of the device of FIG. 1, partially sectioned, taken from line 2—2 of FIG. 1.
FIG. 5 is an enlarged detailed view of the means for mounting the chutes.

In accordance with the present invention, however, an improved feeder mechanism is provided. As seen in FIGS. 2 and 3, the feeder 14 comprises an enclosed, generally box-like housing 32 extending vertically above belt 10 at the rear end of the table 12. Extending into one side of the housing is a delivery conveyor 34 comprising an endless belt mounted about a pair of spaced rollers 36 and 38 at least one of which is driven by conventional motor M and transmission means. This delivery conveyor 34 is inclined upwardly to carry leaves deposited thereon in the direction of the incline, as indicated by the arrow B. Located below the high end of conveyor 34 is a doffer roller or wheel 40 having one or more paddles 42 extending tangentially or even radially therefrom. This doffer roller is not essential to the present invention but is shown only because it is habitually employed on conventional picking tables. A discharge conveyor 44, similar in structure to the first, is provided having an endless belt mounted on a pair of spaced rollers 46 and 48, one of which is driven. The transmission may be common as seen in dotted lines for both conveyors 34 and 44, as well as the doffer wheel 40. The discharge conveyor 44 extends in an upward incline from below the doffer wheel 40 outwardly of the housing. The upper end of the delivery conveyor 34 and the lower end of the discharge conveyor 44 are normally spaced from the doffer wheel 40 an amount sufficient to direct at least a portion of the tobacco leaves falling from the delivery conveyor 34 onto the belt 10 below the housing, the remaining portion being allowed to fall on the discharge conveyor 44 for removal to a subsequent picking table.

The doffer wheel 40 is connected by suitable pulley or similar transmission means to the drive motor M and its speed is regulated by suitable gearing to provide for a greater or lesser degree of diversion of tobacco depending upon the desired rate of tobacco flow to the table. The doffer wheel is mounted on a shaft 50 journalled in a bearing located in a horizontal slot 52, and is provided with means for adjusting its actual position between the conveyors to thus regulate the amount of leaf diverted. The doffer wheel may be adjusted to bar the division of the leaves entirely, if so desired.

The doffer wheel 40 propels the tobacco leaves into the housing toward the vertical baffle 54 which arrests the leaves and causes them to fall downwardly in the vertical direction. Located, according to the present invention, in the lower portion of the housing 32 are three slides 56, 58 and 60. The slides are fixed at their upper ends 62 to the side 64 of the housing below the delivery conveyor 34 and extend in cantilevered fashion toward the table with their lower ends spaced from and free from contact with the belt. The slides extend obliquely to the belt 10 at different angles relative to the vertical wall, or the fall of the tobacco, to deflect a portion of the leaves at an angle to the vertical and transversely to the direction of the belt movement A.

The slides 56, 58 and 60 are approximately the same dimension but fan out, downwardly, at different angles to thus divide the belt below it, between the side walls of the housing 32, into four transverse portions A, B, C, and D and lengthwise portions A′, B′, C′ and D′ defined by the dotted lines. In the embodiment seen in FIG. 2, the chutes 56, 58 and 60 are set at angles of approximately 45°, 30° and 25° respectively, with the vertical wall 64 on which they are secured to form the lengthwise portions A′, B′, C′ and D′. The first chute 56 is fixed to the rear wall as well as the side wall while the other two are staggered forwardly with respect to it, so that the width of the belt or table is thus divided into the four portions A′, B′, C′ and D′, as seen in FIG. 4. The slides 56, 58 and 60 are staggered axially between the front and rear walls of the feeder housing. The rearmost slide is mounted on the rear wall while the foremost slide is spaced from the front wall so that a portion of the side wall 64 also forms a slide surface. The exact angular relationship and dimensions of the inclined slides may vary according to the desired application and the dimensions of the picking table as well as other factors.

In operation tobacco leaves are delivered in a continuous random stream of heavy mass and substantial depth by a suitable overhead conveyor and then deposited on the infeed conveyor 34 where they maintain the mass and depth. The tobacco is dropped on to the doffer wheel 40 and is in part diverted onto the housing 14 and in part passed onto the discharge conveyor 44 where it moves to a feeding station of a subsequent inspection and sorting station. The doffer wheel 40 is adjusted as indicated, to provide an initial loosening of the concentration of tobacco leaf and it in conjunction with the baffle 54 cause the leaves to fall vertically onto the chutes 56, 58 and 60. Thus tobacco propelled into the housing will be delivered onto one or more of the chutes in a vertical direction and be caused to slide serially thereon onto the belt. This occurs because the incline of the chute prevents direct vertical fall, and the leaf being directed to an angle from its original trajectory is caused to fall sequentially in the order it hits the chute. Because of the movement of the belt below the chute, the serially sliding leaf is carried off from the chutes at an accelerated pace also because its direction is changed at a sharp angle to its sliding path. Because of the staggered relationship of the chutes and their angular disposition, tobacco leaves falling on one chute will be deposited in a substantially grid like pattern only in the longitudinal and transverse portion defined by the letters associated with each chute.

It will be seen that the tobacco stream delivered into the housing feeder 14 from the infeed conveyor is perpendicular to the plane to the belt and that the slides deflect the tobacco oblique to the plane of the belt and the direction of delivery, and transversely to the belt surface itself in defined paths, relative to given surface areas of the belt.

Because of the heterogeneous delivery of tobacco leaves onto the conveyor 34 and the random selection by the doffer wheel 40, and the distribution of the chutes 56, 58 and 60 portions of the tobacco leaves are caused to be deposited on the belt 10 in spaced, separated fashion in a grid like manner covering the entire area of the conveyor. The speed of the flow of tobacco and its distribution should be preferably regulated by adjusting the speed of the infeed conveyor 34 and/or the doffer wheel 40 and/or the speed of the belt 10. However, changes made in the flow rate hardly influence the separate distribution of the leaf on the belt since, as will be obvious, the angular relationship of the chutes with respect to the conveyor 34 and the belt 10 effectively prevent the deposition of one leaf on another, and insure a serial, sequential separation of the leaf because of the angular changes in the leaf path.

In FIGS. 1 - 4, the chutes are permanently secured to the housing. An embodiment is shown in FIG. 5 in which the angle of the chutes and their staggered relationship may be more or less freely adjusted. In the FIGURE only the detail of one chute is shown. In this embodiment, the chutes 56, 58 and 60 are provided with a semi-circular lip 66 on their upper ends which lip rests on a rod 68 fixed between the front and rear walls of the housing adjacent the side wall 64. The corners of each of the interior chutes may be cut so as to permit the adjacent chute to slide in the axial direction on the rod so that portion of the chute can overlap the adjacent chute without interference. This is not always necessary and one may be made to overlap the other even on the rod. Extending from the underside of each of the chutes, through slots 70 in the side wall is a level arm 72 formed with a plurality of teeth 74 on their lower edges as on a ratchet. The teeth are adapted to rest on the edges of the slots through which the arms extend. The angle and the staggered relationship may be varied by merely sliding the chutes from front to back and pivoting them on the rod as is indicated by the dotted lines in FIG. 6. More elaborate means may be provided to secure the arm, as for example, a clamp, pin means, rotatable screw adjusting means, and worm gearing etc. Such conventional fastening means will readily lend themselves to those skilled in this art. Rather than the rod 68, an elongated hook member may be secured to the side wall 64 providing a seat for a shallower lip 66, all as seen in FIG. 7.

In any of the various embodiments the chutes may or may not be made with stiffening of strengthing means such as the depending ridges or edges 76 along each of its edges or as a central back bone. The lower edges may be bevelled, turned or formed with enlarged ends, if desired. Also vertical diverting plates 78 may be arranged to depend from the under side of the chutes to further limit the area defined on the belt for disposition of the leaf as seen in FIGS. 5 and 6.

Further, in accordance with the present invention the front end of the table has been covered with a shroud generally depicted by the numeral 80. The cover 80 is intended to overcome a considerable disadvantage found in the prior art, when belt speeds and rejection rates are increased. At increased speeds the ballistic trajectory of individual leaf is such that an air jet on a rejected leaf may cause it to be shot over the rejection hopper 26, while ambient air or drafts moving through the processing plant could divert leaf from the hopper 22. The cover 80 is provided with a pair of side walls 82 (84), a top wall 86 continuously extending into a curved sloping rear wall 88 which extend from above the table height to the floor on which the table 12 stands. Generally, the hoppers 22 and 26 themselves extend through a hole in the floor on to a moving conveyor passing each of the similar picking tables so that the leaves picked at each table may be commonly accumulated. In lieu of a hole in the floor the common conveyor may be built on the floor below the hopper 22. Thus, except for the opening 90 facing the front end of the table the cover 80 encloses the entire area surrounding the hoppers 22 and 26 and the desired path for the tobacco leaf. The distance at which the upper wall 86 is spaced from the table 12 is not critical except that it should be sufficiently high not to interfere with tobacco movement and yet not so high that it would permit ambient drafts or wind from also interfering with desired operation.

As seen in FIG. 1, the photo-cell 18 is mounted on an upward edge 92. It is not intended that the two be necessarily combined as shown and in actuality it is probable that the photo-cell will be independently mounted at height more distant from the plate than shown. The height of the cover 80 can be adjusted to be adaptable to any electronic system.

Nevertheless, the shroud has still a further advantage in that it provides an unexpected and highly desirable blockage of transient and ambient light from falling on the plate 16 and thus providing spurious and erroneous signals in the photo-cell. The shroud provides for a constant, uniform light distribution over the table even during changes in sunlight, and working lights.

A still further improvement according to the present invention is seen in FIG. 1. Normally, the hoppers 22 and 26 would be separated merely by a partition similar to wall 94. This had the disadvantage that often individual leaf would cling and hang up on the edge of the wall and be kicked over into the wrong hopper by a succeeding leaf. This disadvantage has been overcome by providing a wall 96 secured to the partitions 94 having a fulcrum like edge extending transverse along the entire width of the hoppers 22 and 26. Freely resting on the fulcrum edge is a semi-circular tipple plate 98 having a smooth surface whose arms 100 hang well below the fulcrum so as to place its center of gravity along an axial line below the resting edges but within the plane of the wall. The tipple plate is thus able to pivot on the fulcrum edge without becoming unseated from the wall 94. Tobacco leaves striking the tipple plate unbalances the plate causing it to tip either clockwise or counterclockwise as indicated by arrow C. Thus, if a leaf should fall on the tipple plate its own weight would cause it to fall into the hopper, depending on which side of the fulcrum it fell. If a leaf came to rest on the plate and was not heavy enough to fall, a succeeding leaf would help to subsequently dislodge it. Consequently, leaves will not pile up on the wall or be deflected into the wrong hopper.

The wall 96 is fastened by bolts 102 fitting in vertical slots 104 so that the wall and tipple plate may be vertically adjusted with regard to the table, so as to take into account the size and weight of different leaf grades. If desired, the tipple plate may be made with extending axial pins etc., fitting in curved slots in the walls 83 (84) to prevent them from being dislodged due to being hit or struck by the machine operator, or otherwise.

Returning to FIG. 1 the picking table may, in accordance with a further aspect of the present invention, be provided with a shield 110 having a curved upwardly extending rear end 112 and a flat under surface 114. The plate 110 extends coextensively with the run of the belt 10 from a rear edge adjacent the feeder 14 to a front edge adjacent the vertical plane directly ahead of the end plate 16 and sensing head 18. Preferably, the plate is transparent plastic, because of its obvious low cost, high impact and structural strength characteristics. It may, however, be made of plywood, glass, fiber board or any other suitable material.

The shield is supported along each of its sides by a plurality of adjustable brackets 116 connected to a bracket 118 secured to the side wall housing of the conveyor by an adjustable rod 120 so as to lie in a substantially horizontal plane above the conveyor belt 10 at a variable distance. The rods 120 are adjustable so that the height of the shield 110 above the belt 10 can be carried as desired; determined by the speed of the belt, the type of tobacco leaf and other factors as hereinafter described, generally the shield will have a height of between 4 – 8 inches. The closer the shield is placed to the conveyor belt 10, the greater the pressure differential on the leaf. However, because leaves vary not only in over all size but in thickness, density and weight, the height must be determined for each general grade to be conveyed.

The shield and the conveyor cooperate to provide a longitudinal passage from the feeder 14 to the end plate 16. Side walls 122 are arranged in the embodiment shown between the shield and the frame of the conveyor to enclose the assembly and form a tunnel-like chamber open only at the rear and front ends.

The drive motor (not shown) for the belt would, in cooperation with the use of the shield 110, be provided with speed regulating means of a conventional type so that the velocity of the belt could be varied.

The shield and the housing conveyor produce an air current within the passage which flows in the general direction of the belt 10 at a speed at least equal to its speed but with a vertical differential or laminar component from the shield to the conveyor belt which increases the pressure on top of the leaves. Thus, leaf deposited on the belt held by the increased pressure down against the surface of the belt exactly in the manner they were deposited from the feeder onto the belt. For example, the grid like orientation provided by the chute means previously described will remain and the leaves will be carried throughout the run of the belt without jumping, rolling over, flying or shifting longitudinally or laterally during its entire run. In this manner the belt or conveyor speed have been increased to degrees far in excess of any contemplated by the prior art. In fact speeds of 1000 feet per minute or in excess thereof have been obtained without disturbing the position of the leaf on the belt while insuring positive carriage of the leaf.

Sometimes when particularly light pieces such as tips or small leaf particles are conveyed an auxiliary air flow is helpful to increase the pressure differential within the tunnel. A push type fan at the rear of the belt or suction fan may be used at the front end of the belt to produce an independent flow current. On the other hand, suction may be applied through the conveyor belt in which case the belt is formed as a porous member or one having holes therein, and a suction box located beneath the lower face of the belt. Still further, a second belt may be arranged below the shield to move a speed at least equal to that of the conveyor belt 10. This high speed second belt will also create the pressure gradient acting on the top of the leaf. A continuous belt secured over a pair of spaced rollers, having a lower run beneath the shield and an upper run over it, driven by an independent small motor or connected by suitable step-up gear to the conveyor belt motor can be utilized. In any event, one of each of the special forms described permits a pressure gradient or laminar differential to be created in the air current in the tunnel which depress the leaf so that the leaf is held firmly to the conveyor belt throughout its run.

As indicated, the speed of the belt, the height of the shield effect the pressure differential on the flow of air through the passage and the conveyance of leaf in the predetermined orientation. It is a simple matter to regulate either or both the speed of the belt and the height of shield to obtain the highest speed of belt at which the leaf would maintain their predetermined oriented positions. A slight degree of empirical observation will be necessary, but this is a common factor and well known technique in the tobacco art.

It will be obvious that the various aspects and constructions of the present invention are most suitable for cooperative use together, since each contributes an advantage to the sum of the whole. For example, by arranging the feed chutes, the shield above the conveyor, and the hopper cover, etc., photo-electric sensing has been sped up to where it is now many times faster than hand picking and faster by far than existing automatic systems. However, it will be clearly obvious as well that the various aspects may be used in any combination and each may indeed be used alone, if desired. Thus, the shroud over the hoppers, the tipple bars, the feeder chutes and even the cover shield last described may be used together or independently.

It will be obvious to those skilled in this art, that various modifications and changes may be made. Accordingly, the present disclosure is intended to be illustrative only.

What is claimed is:

1. In the system for sorting tobacco leaf wherein said leaves are carried on a horizontal endless belt conveyor past a sensing station, the method of delivering said leaves from a source to said conveyor comprising the steps of feeding within an enclosed housing vertically disposed above said conveyor a random stream of said leaves so as to fall perpendicularly to said conveyor deflecting said leaves in a plurality of selected paths, each intersecting a major portion of said perpendicularly falling stream within said housing transversely to the direction of movement of said conveyor before reaching said conveyor, each of said selected paths being inclined in a direction obliquely angular to the perpendicular direction of the said falling stream, the direction of movement of the conveyor and the plane of said conveyor to cause the leaves within said falling stream to be deflected at different times and move relative to each other sequentially downwardly at angles to the direction of said vertical stream, the conveyor and the direction of movement of said conveyor and depositing said leaves on said conveyor in spaced orientation.

2. The method according to claim 1, including the step of deflecting said leaves so that said leaves are deposited on said belt in a relative predetermined grid-like pattern in transverse and longitudinally intersecting protions of said belt.

3. Apparatus for separating and distributing a heterogeneous mass of tobacco leaf on an endless belt conveyor, said conveyor continuously moving in a linear direction in a given plane, comprising means located above said conveyor for directing a stream of said heterogeneous mass of tobacco in a vertical direction toward said conveyor and slide means comprising at least two stationary slide surfaces interposed between the means for directing the stream and conveyor, one of said slide surfaces fanning out from the other at an oblique angle, each of said slide surfaces intersecting a major portion of said vertical stream and extending in a plane oblique to the vertical direction of the stream of tobacco, the plane of the conveyor and the direction of travel to deflect respective portions of said mass of tobacco leaf at different times relative to each other and to cause said leaf to move sequentially onto different portions of said conveyor in paths oblique to the plane of said conveyor and transverse to its direction of movement.

4. Apparatus for depositing tobacco leaf in a grid-like pattern on a horizontal belt conveyor moving in a linear direction, comprising a housing located at the rear end of said conveyor and having a pair of parallel vertical side walls and front and rear walls arranged above said conveyor, supply means for supplying stream of tobacco to said housing to fall vertically within said walls, and a plurality of stationary inclined slides arranged between said front and rear walls, each of said slides being secured to one of said walls and extending beneath the falling stream of tobacco downwardly toward said conveyor in planes set at different angles to the vertical, and obliquely to the plane of said conveyor and to its direction of movement, the lower end of said slides being spaced from said conveyor, the angle of each of said slides relative to the vertical increasing respectively from said front to rear walls, said slides deflecting portions of said leaves at different times to cause said falling tobacco to move sequentially onto different areas of said conveyor.

5. Apparatus according to claim 4 for photo-electrically grading tobacco leaf wherein said leaf is carried on a conveyor past a sensing head and is selectively ejected from the end of said conveyor in response to a signal from said head, to one of at least two hoppers, the improvement of a shroud covering the end of said conveyor and said hopper to prevent interference with the ejection of said leaf and to confine the trajectory thereof.

6. The apparatus according to claim 4 wherein said slides are pivotally secured to said one wall and are provided with means for adjusting their relative angular positions.

7. The apparatus according to claim 4 wherein said slides are arranged one behind the other in the direction of movement of said conveyor to present a staggered array relative to said belt.

8. The apparatus according to claim 7 wherein said slides comprise a plurality of members arranged at different angles to the conveyor.

9. The apparatus according to claim 4 wherein said slides are spaced from said front wall, a portion of said slide wall on which said slides are secured adjacent said front wall forming a slide.

10. The apparatus according to claim 9 wherein said slides are three in number, and are arranged at approximately 25°, 30° and 45° angles from the vertical.

11. Apparatus for separating wherein adjacent areas receive tobacco leaf pneumatically propelled over at least one of said areas, comprising a vertical wall having a upper edge extending between said areas, a curved plate having a smooth upper surface, balanced on the upper edge of said wall to pivot to either side thereof, the center of gravity of said plate being located below the upper edge of said wall to prevent said plate from falling off said edge due to impact of a leaf.

12. The apparatus according to claim 11 wherein said curved plate is substantially semi-circular in cross section and extends the length of said areas.

13. The system for grading tobacco leaf wherein said leaf is carried on a conveyor past a sensing station, sensing said leaf and pneumatically ejecting certain leaf responsive to said sensing from said conveyor into one of two receiving areas arranged adjacent each other in line with the direction of movement of said conveyor, said areas being separated by a wall having an edge extending the length of said areas and a tipple plate pivotably mounted on said edge having an axis containing the center of gravity thereof extending parallel to said edge and spaced below said edge coplanar with said wall.

14. In a system for grading tobacco leaf wherein said leaves are carried on a continuously movable horizontally endless belt past a sensing station, the method of delivering said leaves from a source to said belt comprising the steps of feeding said leaves in a random stream, separating said leaves from said stream and depositing said separating leaves by way of a defined path in a predefined pattern on said belt, covering said conveyor with a shield to form a continuous chamber for said leaves and selecting the speed by said belt and arranging the height of said shield to cooperate with said belt in providing a concurrent flow of air above said leaves to maintain said leaves on said belt in its predetermined pattern during the entire run of said conveyor.

15. The system according to claim 14 including the step of applying an independent air flow to the chamber between the belt and shield.

16. Apparatus for conveying leaf tobacco comprising a substantially endless horizontal belt having a leaf-supporting run to which leaves are supplied, means for driving said conveyor to propel said leaf therealong, a shield arranged in spaced parallel relationship to said belt run to form a longitudinal passage open at its ends and in which an air pressure is formed above and below said leaves on movement of said conveyor, the air pressure above said leaf being greater than the air pressure between said leaves and said belt to force said leaves in contact with said belt.

17. The apparatus according to claim 16 including means for depositing leaves on said conveyor in a predetermined orientation, and means for regulating the speed of said conveyor to control the flow of air within said passage whereby a layer of air of greater pressure is created above said leaves throughout its run to maintain said leaves in said predetermined orientation.

18. The apparatus according to claim 16 wherein said shield comprises a member having a flat face opposed to said conveyor and extending substantially coextensively therewith.

19. The apparatus according to claim 18 including means for adjustably supporting the shield above the conveyor run.

20. The apparatus according to claim 18 including means for enclosing the sides of said passage between said shield and said conveyor, to form a substantial tunnel open at each end.

21. The apparatus according to claim 18 including means for separately causing an air flow pressure differential within said passage.

22. The apparatus according to claim 21 wherein said air flow differential is caused by creating an air flow at the rear end.

23. The apparatus according to claim 21 wherein said air flow differential is caused by creating a suction at the front end.

24. The apparatus according to claim 21 wherein said air flow differential is created by movable belt arranged between the shield and said leaves, said belt being moved at a speed at least equal to the speed of said conveyor.

25. The apparatus according to claim 21 wherein said air flow differential is created by applying suction through said conveyor.

* * * * *